United States Patent [19]

Reinsdorf

[11] 4,377,939

[45] Mar. 29, 1983

[54] CONVERTIBLE JEWELRY WITH BELT AND NECKLACE ATTACHMENT MEANS

[76] Inventor: Martyl Reinsdorf, 176 Hastings Rd., Highland Park, Ill. 60035

[21] Appl. No.: 270,268

[22] Filed: Jun. 4, 1981

[51] Int. Cl.[3] ..... A44C 25/00

[52] U.S. Cl. ..... 63/2; 24/163 K; 24/186; 63/23

[58] Field of Search ..... 63/2, 3, 23; 24/163 R, 24/163 FC, 163 K, 186, 187, 188, 189

[56] References Cited

U.S. PATENT DOCUMENTS

| | | | |
|---|---|---|---|
| 235,683 | 12/1880 | Jeanne et al. | 63/1 R |
| 686,197 | 11/1901 | Bippart | 63/1 R |
| 3,908,239 | 9/1975 | Gorman | 24/163 K |
| 4,135,267 | 1/1979 | McKinney et al. | 24/163 K X |

FOREIGN PATENT DOCUMENTS

| | | | |
|---|---|---|---|
| 558284 | 5/1923 | France | 63/2 |

*Primary Examiner*—F. Barry Shay
*Attorney, Agent, or Firm*—Irwin C. Alter

[57] ABSTRACT

Convertible jewely for display as both a belt buckle and a pendant. Affixed to the rear portion of an ornamental object are belt attachment fixtures and a necklace attachment fixture. The necklace attachment fixture facilitates display of the ornamental object as a pendant. The belt attachment fixtures rotate to an extended position and a retracted position. In the extended position, the belt attachment fixtures facilitate display of the ornamental object as a belt buckle. When not in use, the belt attachment fixtures are rotated into their retracted positions so as to minimize their rear extension.

5 Claims, 11 Drawing Figures

CONVERTIBLE JEWELRY WITH BELT AND NECKLACE ATTACHMENT MEANS

BACKGROUND OF THE INVENTION

This invention relates in general to jewelry, and more particularly, to convertible jewelry.

An attractive ornament is converted into jewelry by adding thereto an attachment fixture which facilitates display of the ornament. Different types of jewelry have different types of attachment fixtures. Jewelry such as rings and necklaces must be equipped with fixtures which facilitate attachment of an ornament to particular parts of the human body, while lapel pins and belt buckles have fixtures designed to facilitate attachment of the ornament to particular pieces of clothing. The unique nature of each type of attachment fixture limits the versatility of the jewelry. Therefore, a pendant equipped with a pendant attachment fixture cannot be used as a belt buckle unless a belt buckle attachment fixture is added thereto.

In the past, the decorative nature of a piece of jewelry was damaged by adding multiple attachment fixtures. Multiple attachment fixtures added obvious bulk to the jewelry and often made the jewelry uncomfortable to wear. The additional bulk also prevented proper display of the jewelry by causing it to stand away from the body or tilt to one side.

Accordingly, the present invention has as an object, the provision of jewelry having multiple attachment fixtures for belt buckle and pendent display.

Another object of the invention is the provision of jewelry having multiple attachment fixtures which are inobtrusive.

A further object of the invention is the provision of jewelry having light-weight multiple attachment fixtures.

An additional object of the invention is the provision of jewelry having multiple attachment fixtures which rotate to a retracted positioned when not in use.

Yet another object of the invention is the provision of jewelry having multiple attachment fixtures which do not detract from the overall appearance of the ornament.

These and other objects of the invention will become apparent upon consideration of the following specification and drawings.

SUMMARY OF THE INVENTION

The present invention comprises convertible jewelry which can be displayed as both a belt buckle and a pendant.

The jewelry includes an ornamental object which has a front portion and a rear portion. Attached to the rear portion of the ornamental object are belt attachment fixtures and a necklace attachment fixture.

In a preferred embodiment, the belt attachment fixtures include a belt clasp and a belt adjustment fixture. The belt clasp has a U-shaped member through which the belt is strung. The U-shaped member is also used for positioning of the ornamental object on the belt. The belt adjustment fixture has a hook portion for inserting into the belt and selectively adjusting the diameter of the belt.

The belt clasp and the belt adjustment fixture are rotatably affixed to the rear of the ornamental object, and rotate to an extended position and a retracted position. When in the extended position, the belt clasp and the belt adjustment fixture facilitate display of the ornamental object as a belt buckle. When the belt clasp and the belt adjustment fixture are not in use, they are rotated into a retracted position, providing minimum rear extension which does not exceed that of the necklace attachment fixture.

The necklace attachment fixture includes a staple restrainably affixed to the rear portion of the ornamental object. The staple has an eyelet raised above the rear portion of the ornamental object through which the necklace is strung. The staple cooperates with the necklace to facilitate display of the ornamental object as a pendant.

In a preferred embodiment, the ornamental object is a cylindrically shaped disc. On the rear of the disc, the belt attachment fixtures and the necklace attachment fixture, are uniformly spaced so as to balance the disc when worn as a pendant.

In another preferred embodiment, the belt clasp and the belt adjustment fixtures, rotated about a 90 degree arc on cylindrical hinge pins.

Included in the design of the present invention are belt attachment fixtures which do not contact the necklace attachment fixture, and do not interfere with the necklace attachment fixture when the ornamental object is displayed as a pendant. In turn, the necklace attachment fixture is inobtrusive and does not interfere with the belt attachment fixtures when the ornamental object is displayed as a belt buckle.

DETAILED DESCRIPTION OF THE DRAWINGS

Figure 1:
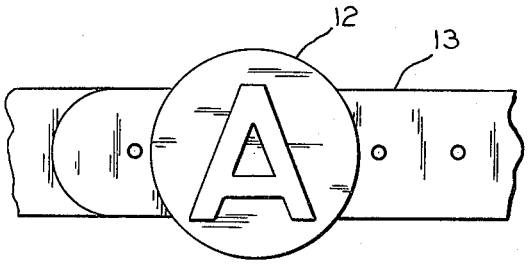
FIG. 1 is a front elevational view, showing an ornamental disc displayed as a belt buckle.

While this invention is susceptible of embodiment in many different forms, there are shown in the drawings and will herein be described in detail, several specific embodiments with the understanding that the present disclosure is to be considered as an exemplification of the principles of the above invention and is not intended to limit the invention of the embodiments illustrated.

An ornament, as shown in FIG. 1, is a cylindrical disc displayed as a belt buckle attached to belt 13. In addition to its ornamental function, disc 12 also serves to functionally adjust the diameter of belt 13.

Figure 2:
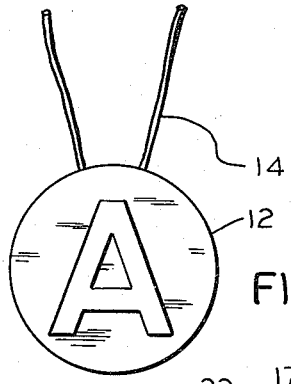
FIG. 2 is a front elevational view, showing an ornamental disc displayed as a pendant.

FIG. 2 shows ornamental disc 12 displayed as a pendant. Disc 12 attaches to necklace 14, enabling disc 12 to be worn around the neck. When displayed as a pendant, disc 12 is strictly ornamental.

Figure 3:
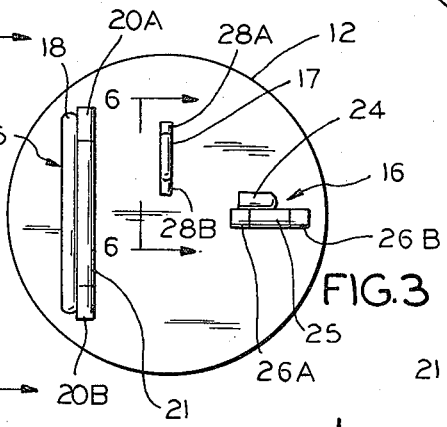
FIG. 3 is a rear elevational view of the ornamental disc, showing particularly multiple attachment fixtures in an extended position.

The rear view in FIG. 3 shows multiple attachment fixtures by which ornamental disc 12 attaches to belt 13 and necklace 14 shown in FIGS. 1 and 2. Belt clasp 15 and belt hole insert 16 cooperate with belt 13 to display disc 12 as a belt buckle and to adjust the diameter of belt 13. Staple 17 cooperates with necklace 14 to suspend disc 12 when disc 12 is displayed as a pendant.

Figure 4:
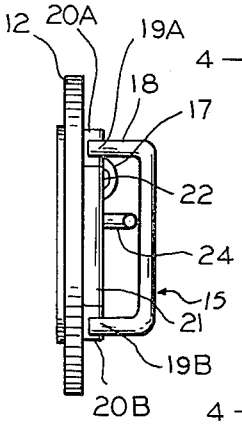
FIG. 4 is a side view of the ornamental disc of FIG. 3.

As shown in FIG. 4, belt clasp 15 has U-shaped member 18 having ends 19*a* and 19*b*. U-shaped member ends 19*a* and 19*b* are restrainably affixed to the left side of clasp feet 20*a* and 20*b*. Clasp feet 20*a* and 20*b* are rotatably connected above and below clasp foot support 21, to facilitate limited rotation of U-shaped member 18. Also shown in FIG. 4 is staple 17 having eyelet 22. Staple 17 does not extend beyond clasp 15 or belt hole insert 16, and does not interfere with either when disc 12 is displayed as a belt buckle.

Figure 5:
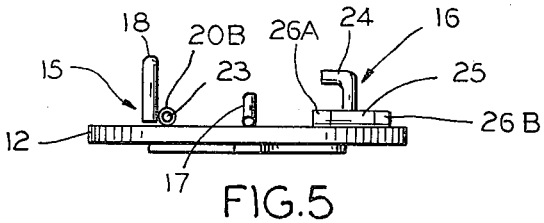
FIG. 5 is a bottom view of the ornamental disc of FIG. 3.

FIG. 5 is a bottom view showing both clasp 15 and belt insert 16 in an extended position. Clasp hinge pin 23 is operably disposed within clasp feet 20*a* and 20*b*, and clasp foot support 21. Rotation of U-shaped member 18 is limited by ends 19*a* and 19*b* contacting disc 12. Therefore, the retracted position for clasp 15 is obtained by rotating U-shaped member 18 in a clockwise direction about a 90 degree arc. Also shown in FIG. 5 is belt hole insert 16 having hook portion 24 affixed to hook base 25. Hook base 25 is rotatably connected to hook base supports 26*a* and 26*b*, to facilitate limited rotation of hook portion 21.

Figure 6:
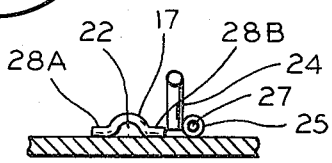
FIG. 6 is a cross-sectional view of the ornamental disc of FIG. 3.

FIG. 6 shows belt hole insert 16 in an extended position. Hook base hinge pin 27 is operably disposed within hook base 25, and hook base supports 26*a* and 26*b*. As shown in FIG. 6, hook portion 24 is affixed to the left side of hook base 25. Therefore, the rotation of hook portion 25 is limited to a 90 degree arc. The retracted position of belt hole insert 16 is obtained by rotating hook portion 24 in a clockwise direction about a 90 degree arc. Also shown in FIG. 6 is staple 17. Staple 17 has staple ends 28*a* and 28*b* affixed to disc 12. Eyelet 22 is sufficiently raised from disc 12 to facilitate insertion of necklace 14 as shown in FIG. 2. However, it can be seen in FIGS. 5 and 6 that staple 17 does not extend beyond belt clasp 15 or belt hole insert 16 when they are in their extended positions. Therefore, staple 17 does not interfere with the functional operation of either belt clasp 15 or belt insert 17, when disc 12 is displayed as a belt buckle.

Figure 7:
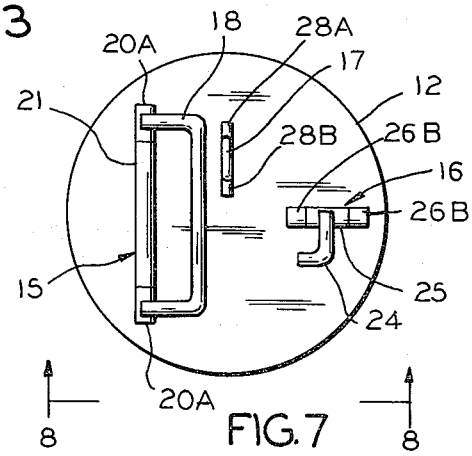
FIG. 7 is a rear elevational view of the ornamental disc, showing particularly multiple attachment fixtures in a retracted position.
Figure 8:
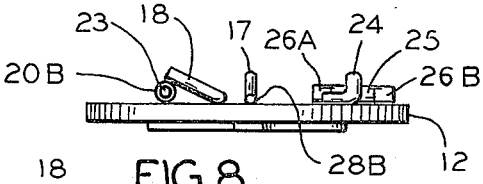
FIG. 8 is a bottom view of the ornamental disc of FIG. 7.

FIG. 7 is a rear view of disc 12 showing belt clasp 15 and belt hole insert 17 in a retracted position. As shown in FIG. 8, U-shaped member 18 and hook portion 24 contact disc 12 when belt clasp 15 and belt hole insert 16 are in their retracted positions. As shown in both FIGS. 7 and 8, U-shaped member 18 and hook portion 24 do not contact staple 17 when they are in their retracted positions. Thus, belt clasp 15 and belt hole insert 16 do not interfere with the proper display of disc 12 when worn on a necklace.

Figure 9:
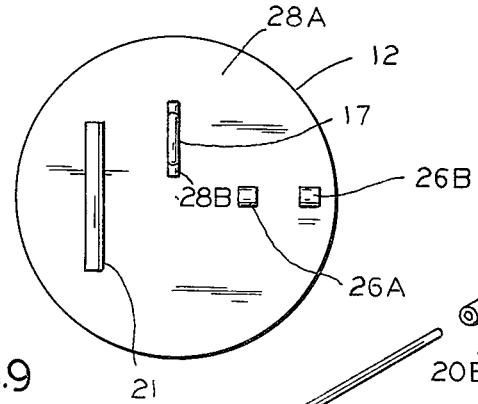
FIG. 9 is a rear elevational view of the ornamental disc, showing particularly the stationary members of the multiple attachment fixtures.

FIG. 9 is a rear view of disc 12 showing those attachment members which are permanently affixed thereto. Staple 17 is mounted along a vertical line which is equal distance from clasp foot support 21, and hook base supports 26*a* and 26*b*. This arrangement adds balance to disc 12 and facilitates proper display of disc 12 when worn on a necklace.

Figure 10:
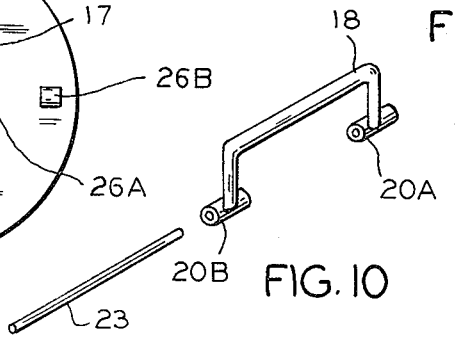
FIG. 10 is a schematic view showing a rotatable belt clasp and hinge pin.
Figure 11:
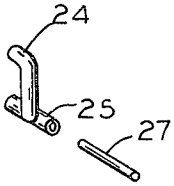
FIG. 11 is a schematic view showing a rotatable belt hole insert and hinge pin.

FIG. 10 shows U-shaped member 18 and clasp feet 20*a* and 20*b* removed from disc 12. Belt clasp hinge pin 23 is shown as a long cylindrical rod. The length of belt clasp hinge pin 23 is determined by the combined lengths of clasp feet 20*a* and 20*b*, and clasp foot support 21. Similarly, FIG. 11 shows hook portion 24 and hook base 23 removed from disc 12. Hook base hinge pin 27 is shown as a short cylindrical rod. The length of hook base hinge pin 27 is determined by the combined length of hook base 25, and hook base supports 26*a* and 27*b*.

The low profile of belt clasp 15 and belt hole insert 16 when in their retracted positions, does not interfere with the display of disc 12 on a necklace. In turn, staple 17 does not interfere with a display of disc 12 as a belt buckle. These multiple attachment fixtures unobtrusively add a great degree of flexibility to the display of an attractive ornament.

The foregoing description and drawings merely explain and illustrate the invention and the invention is not limited thereto, except insofar as the appended claims are so limited as those skilled in the art who have the disclosure before them will be able to make modifications and variations therein without departing from the scope of the invention.

What is claimed is:

1. Convertible jewelry comprising:

an ornamental object;

said ornamental object having a front portion and a rear portion;

belt attachment means;

said belt attachment means having belt clasp means and belt adjustment means;

first connecting means and second connecting means rotatably connecting said belt adjustment means and said belt clasp means, respectively, to said rear portion of said ornamental object, whereby each is rotatable between extended and retracted positions relative to said rear portion of said ornamental object;

said belt attachment means facilitating display of said ornamental object on a belt;

necklace attachment means;

said necklace attachment means having loop means affixed to said rear portion of said ornamental object;

said belt attachment means cooperating with said necklace attachment means to facilitate display of said ornamental object on a necklace.

2. The invention according to claim 1 in which said belt clasp means includes a U-shaped member through which said belt is strung for positioning said ornamental object.

3. The invention according to claim 1 in which said belt adjustment means includes hook means, said hook means designed to cooperate with apertures in a belt for securing said belt or, when utilized in conjunction with a multiplicity of such apertures, for the selective adjusting of the diameter of said belt.

4. The invention according to claim 1 in which said loop means of said necklace attachment means comprises staple means affixed to said rear portion of said ornamental object;

said staple means cooperating with the surface of said rear portion of said ornamental object to define an aperture therebetween;

said aperture facilitating the display of said ornamental object as a pendant by permitting necklace means to pass securedly therethrough.

5. The invention according to claim 4 in which said belt clasp means and said belt adjustment means, when rotated to their respective retracted positions, extend from said rear portion of said ornamental object distances less than or substantially equal to the protruding distance of said staple means.

* * * * *